United States Patent [19]

Monteiro

[11] 4,126,484

[45] Nov. 21, 1978

[54] PAINT ROLLER CLEANER AND METHOD

[76] Inventor: Charles C. Monteiro, R.F.D. Sandwich Rd., Falmouth, Mass. 02541

[21] Appl. No.: 802,479

[22] Filed: Jun. 1, 1977

[51] Int. Cl.[2] ..... B08B 7/100; B08B 3/12

[52] U.S. Cl. ..... 134/34; 134/38; 134/182

[58] Field of Search ..... 134/34, 38, 182, 183, 134/138, 139, 199, 200; 68/186, 187, 213; 210/82, 84

[56] References Cited

U.S. PATENT DOCUMENTS

| | | | |
|---|---|---|---|
| 1,993,175 | 3/1935 | Libbey et al. | 210/82 |
| 2,050,634 | 3/1936 | Stegemann | 134/34 |
| 3,037,516 | 6/1962 | Leach | 134/182 |
| 3,075,534 | 1/1963 | Habostad | 134/138 |
| 3,421,527 | 1/1969 | Dettman | 134/182 |
| 3,431,574 | 3/1969 | Mathieu | 68/213 |
| 3,820,552 | 6/1974 | Lang et al. | 134/113 |
| 3,927,972 | 12/1975 | Kawamura et al. | 68/187 |
| 4,042,416 | 3/1977 | Miskech | 134/34 |

*Primary Examiner*—S. Leon Bashore
*Assistant Examiner*—Chris Konkol
*Attorney, Agent, or Firm*—Clarence A. O'Brien; Harvey B. Jacobson

[57] ABSTRACT

An elongated, hollow, cylindrical body is provided with an end wall at one end through which a liquid inlet opens and the other end of the body is open. The inside diameter of the body is of a size to snugly and slidably receive a paint roller therein and the length of the interior of the body is greater than the length of a paint roller. The open end of the body includes a hook for engagement with the support frame of a paint roller handle structure from which the paint roller to be cleaned is journaled. The paint roller to be cleaned is telescoped into the open end of the body to an extent greater than the length of the paint roller and the frame of the handle assembly is engaged with the hook carried by the body in order to prevent withdrawal of the roller from the body. Thereafter, liquid under pressure is admitted into the interior of the body through the liquid inlet and the liquid under pressure is thereby caused to pass through the nap of the paint roller between the roller core and the internal surfaces of the body to thereby flush paint residue from the nap. The fluid utilized may be water or paint thinner, as desired.

7 Claims, 4 Drawing Figures

PAINT ROLLER CLEANER AND METHOD

BACKGROUND OF THE INVENTION

Various forms of cleaning devices for paint rollers have been heretofore provided. One well known form of paint roller cleaner provides structure whereby a paint roller may be supported for rotation and a jet of water may be directed tangentially onto the exterior of the paint roller along the length thereof whereby a water soluble paint may be flushed from the nap of the paint roller. However, this form of paint roller cleaner does not provide a means whereby a paint roller utilized in conjunction with oil base paints may be cleaned.

Accordingly, a need exists for a paint roller cleaner which may be utilized to clean various types of paint residue from paint rollers.

Examples of previously known forms of paint roller cleaners are disclosed in U.S. Pat. Nos. 3,075,534, 3,421,527, 3,577,280, 3,820,552 and 3,897,797.

BRIEF DESCRIPTION OF THE INVENTION

The paint roller cleaner of the instant invention defines an elongated cylindrical chamber open at one end and closed at the other end. The closed end of the chamber includes liquid inlet means through which liquid under pressure may be admitted into the interior of the chamber and the chamber is of a diameter to snugly telescopingly receive a paint roller cleaner therein. In addition, structure is provided for releasably retaining a paint roller within the chamber against displacement outwardly of the open end thereof whereby when liquid is admitted into the closed end of the chamber under pressure, the liquid will be caused to flow through the nap of the paint roller to be cleaned between the core of the paint roller and the internal surfaces of the chamber to thereby flush paint residue from the nap of the roller.

The main object of this invention is to provide a paint roller cleaner which will be operative to clean a paint roller of paint residue thereon and which will function to clean the paint roller without spinning the latter at high speed.

Another object of this invention is to provide a paint roller cleaner which may be utilized to clean water base paints as well as oil base paints.

Yet another object of this invention is to provide a paint roller cleaner which may be readily utilized by inexperienced persons and which requires only a source of liquid under pressure.

A final object of this invention to be specifically enumerated herein is to provide a paint roller cleaner in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of costruction and operation as more fully hereinafter described and claimed, reference being had to the accompanying drawings forming a part hereof, wherein like numerals refer to like parts throughout.

DETAILED DESCRIPTION OF THE INVENTION

Figure 1:
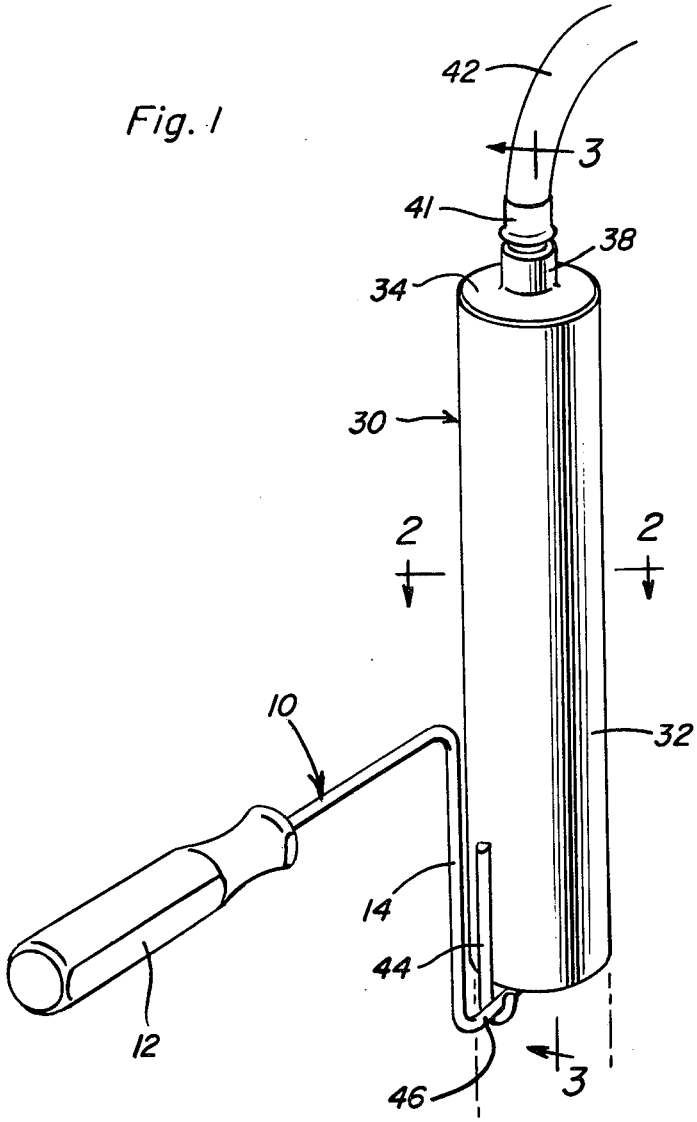
FIG. 1 is a perspective view of the paint roller cleaner of the instant invention in operation to clean a paint roller disposed therein.
Figure 2:
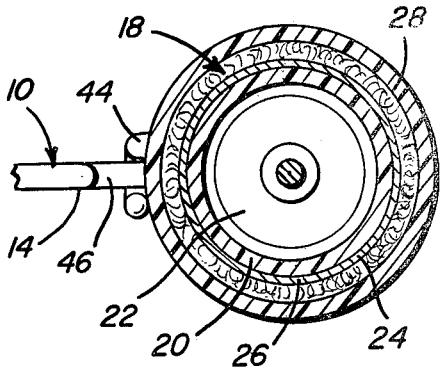
FIG. 2 is an enlarged, sectional view taken substantially upon the plane indicated by the section line 2—2 of FIG. 1.

Referring now more specifically to the drawings, the numeral 10 generally designates a conventional form of paint roller assembly. The roller assembly 10 includes a handle 12 from one end of which a support frame 14 extends. The support frame 14 terminates, remote from the handle 12, in an axle end portion 16 disposed substantially normal to the longitudinal extent of the handle.

The paint roller assembly 10 further includes a paint roller referred to in general by the reference numeral 18. The roller 18 includes a core 20 provided with a pair of opposite end walls 22 secured in the opposite ends of the tubular core 20 and a roller sleeve 24 is snugly telescoped over the core 20 and includes a backing sleeve 26 provided with an outer nap layer 28.

When the roller assembly 10 is utilized for painting purposes, the paint roller 18 is conventionally rolled back and forth across the bottom of a shallow tray having a quantity of paint therein to a level spaced slightly above the pan or tray bottom. In this manner, the nap layer 28 is soaked with paint and when the paint roller 18 is rolled over a surface to be painted, the paint within the nap layer 28 is transferred to the surface.

When painting with the roller assembly 18 has been completed, if the paint roller 18 is to be used again, it is necessary to remove the residue of paint from the nap layer.

The paint roller cleaner of the instant invention is referred to in general by the reference numeral 30 and includes an elongated tubular body 32 provided with an end wall 34 closing one end of the body 32. The opposite end of the body 32 is open and the interior of the body defines a cylindrical cavity or bore 36. The end wall 34 is provided with an inlet neck 38 which is internally threaded as at 40 and is thereby adapted to have the externally threaded male discharge end 41 of a pressurized waterline 42 threadedly engaged therewith.

The open end of the body 32 remote from the end wall 40 includes a hook 44 which projects outwardly beyond the open end of the body 32 and opens toward the closed end thereof.

Preferably, the body 32 is of one piece construction and constructed of an inexpensive and durable material, such as plastic. The hook 44 may be molded integrally with the body 32. However, the body 32 may be constructed of other suitable materials, such as metal, if desired.

Figure 3:
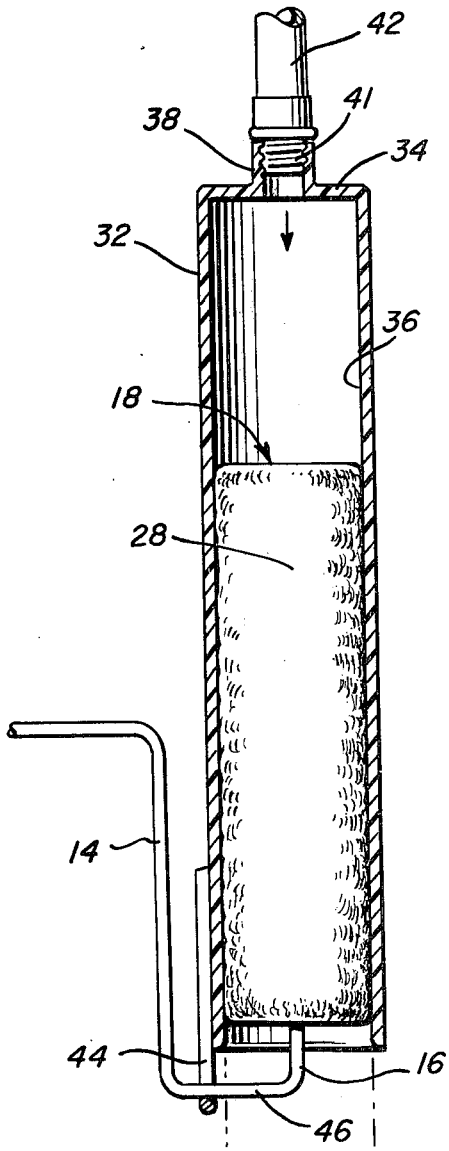
FIG. 3 is an enlarged, vertical sectional view taken substantially upon the plane indicated by the section line 3—3 of FIG. 1.
Figure 4:
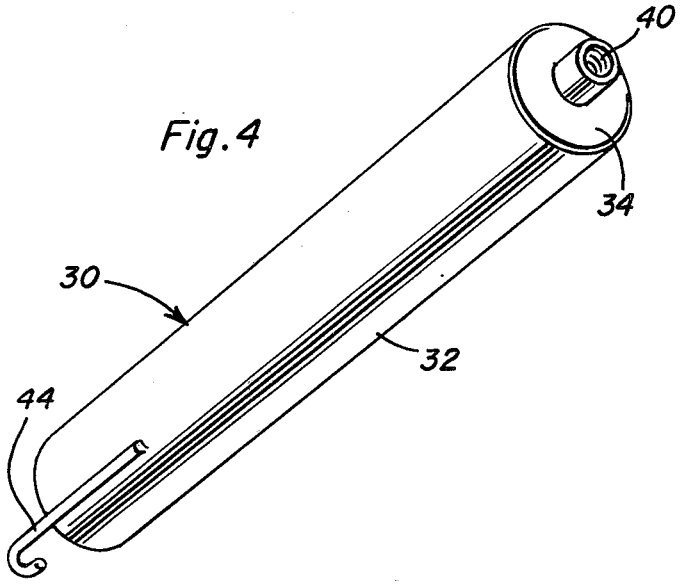
FIG. 4 is a perspective view of the paint roller cleaner.

In operation, if the paint roller 18 has been utilized to paint with water base paint, when the painting operation has been completed, the paint roller 18 is snugly telescoped into the cavity or bore 36 in the manner illustrated in FIG. 3 of the drawings and the portion 46 of the frame 14 is engaged with the hook 44 in order to prevent the roller 18 from being forced from the open end of the cavity or bore 36. Then, water under pressure is admitted into the closed end of the cavity 36 through the inlet neck 38 and the water is thereby forced to pass through the nap layer 28 outwardly of the core 20 and inwardly of the inner surfaces of the body 32 defining the cavity or bore 36. Thus, the water is forced through the nap layer 28 of the roller 18 and flushes the water base paint from the nap layer 28. Of course, the lower end of the body 32 may be positioned over a suitable drain or receptacle to receive the water and diluted paint residue discharged from the lower end of the body 32.

If the roller 18 has been utilized to paint with an oil base paint, the roller 18 should first be rolled through a shallow pan of paint thinner, such as turpentine, and may thereafter be positioned within the body 32 in the manner illustrated in FIG. 3 and water under pressure may be admitted into the closed end of the body 32 in the manner hereinabove set forth. By first rolling the roller 18 through turpentine or another paint thinner, the residue of paint in the nap layer 28 will be sufficiently diluted to enable the high pressure passage of water through the nap layer 28 to flush the same clean of oil base paint residue.

By utilizing the cleaner 30 of the instant invention, the usual spray of water and diluted paint associated with paint roller cleaners of the type designed to discharge jets of water or other cleaning liquids onto a paint roller in order to spin the latter is eliminated and the liquid discharge and paint residue from the lower end of the cleaner 10 may be readily received within a suitable drain or a receptacle provided therefor without any splashing or spraying of paint residue.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a cylindrical paint roller having an outer nap layer, a paint roller cleaner comprising a body having an elongated bore formed therein closed at one end and opening outwardly of said body at the other end, said body including means for admitting liquid under pressure into said one end of said bore, said open end of said body including means operative to releasably retain a paint roller therein, the bore having snugly and telescopically received therein the cylindrical outer nap layer equipped paint roller with no clearance between the outer extremity of the nap layer and the surfaces of said body defining said bore.

2. The combination of claim 1 including a paint roller handle having a generally right angled portion with respect to the roller, said retaining means operative to releasably retain a paint roller therein including a hook extending outwardly of the open end of said body and opening toward the closed end thereof, adapted to hookingly engaged said right angled portion of said handle.

3. The combination of claim 1 wherein said closed end of said body is defined by an end wall extending thereacross, said liquid inlet means opening inwardly through said end wall.

4. The combination of claim 3 wherein said liquid inlet means includes an inlet neck supported from, projecting outwardly of, and opening inwardly through said end wall.

5. The combination of claim 4 wherein said inlet neck is internally threaded for threaded engagement of the externally threaded male fitting of a liquid supply hose therewith.

6. The combination of claim 1 wherein said cleaner is of one piece construction and constructed of plastic.

7. The method of flushing paint residue from the external nap layer of a cylindrical paint roller, said method comprising telescoping the roller into a cylindrical cavity of a diameter to snugly receive said nap layer therein with no clearance between the outer extremity of the nap layer and the surface of the cavity, and thereafter causing a flushing liquid under pressure to pass through said nap layer exteriorally of the roller and internally of said cavity from one end of the roller to the other end thereof.

* * * * *